US005169185A

United States Patent [19]

Slaybaugh et al.

[11] Patent Number: 5,169,185

[45] Date of Patent: Dec. 8, 1992

[54] PANIC EXIT DEVICE FEATURING IMPROVED BAR MOVEMENT AND FAIL SAFE DOGGING

[75] Inventors: Loren E. Slaybaugh, Milwaukee; James M. Huffman, Greendale, both of Wis.

[73] Assignee: Republic Industries, Inc., Chicago, Ill.

[21] Appl. No.: 847,861

[22] Filed: Mar. 6, 1992

Related U.S. Application Data

[63] Continuation of Ser. No. 645,827, Jan. 25, 1991, abandoned.

[51] Int. Cl.[5] ..... E05C 3/16

[52] U.S. Cl. ..... 292/92; 292/21

[58] Field of Search ..... 70/92; 292/21, 92, 337, 292/DIG. 65

[56] References Cited

U.S. PATENT DOCUMENTS

| | | | |
|---|---|---|---|
| 278,066 | 5/1883 | Wernert . | |
| 333,674 | 1/1886 | Rogers . | |
| 786,668 | 4/1905 | Nussbeck . | |
| 805,411 | 11/1905 | Clark . | |
| 824,173 | 6/1906 | Clark . | |
| 919,269 | 4/1909 | Voigt . | |
| 943,973 | 12/1909 | Hope et al. . | |
| 975,456 | 11/1910 | Prevost . | |
| 984,458 | 2/1911 | Witham . | |
| 986,816 | 3/1911 | Girrens . | |
| 990,358 | 4/1911 | Hodgkinson . | |
| 1,010,689 | 12/1911 | Rogers . | |
| 1,014,960 | 1/1912 | Ericson . | |
| 1,016,502 | 2/1912 | Hoyaux . | |
| 1,039,734 | 10/1912 | Hannum . | |
| 1,056,937 | 3/1913 | Pratt . | |
| 1,069,075 | 7/1913 | Voight . | |
| 1,094,677 | 4/1914 | Page . | |
| 1,105,252 | 7/1915 | Carstens . | |
| 1,140,343 | 5/1915 | Arens . | |
| 1,165,436 | 12/1915 | Mochau . | |
| 1,168,792 | 1/1916 | Dyer . | |
| 1,197,111 | 9/1916 | Dyer . | |
| 1,306,560 | 6/1919 | Page . | |
| 1,346,670 | 7/1920 | Page . | |
| 1,441,336 | 1/1923 | Flowers . | |
| 1,539,350 | 5/1925 | Clark . | |
| 1,605,989 | 11/1926 | Rucker . | |
| 1,704,748 | 3/1929 | Kusch . | |
| 2,104,618 | 1/1938 | Hasenfuss | 292/93 |
| 2,146,968 | 2/1939 | Macagno | 292/144 |
| 2,320,298 | 5/1943 | Phillips | 292/92 |
| 2,328,936 | 9/1943 | White | 292/93 |
| 2,426,041 | 8/1947 | Moorhouse | 292/164 |
| 2,732,237 | 1/1956 | Kihn et al. | 292/67 |
| 2,765,648 | 10/1956 | Hatcher | 70/264 |
| 2,785,914 | 3/1957 | Thomas et al. | 292/7 |
| 2,871,050 | 1/1959 | Dickinson | 292/336.3 |
| 2,945,372 | 7/1960 | Reed | 70/92 |
| 2,962,889 | 12/1960 | McConnell | 70/92 |
| 2,992,846 | 7/1961 | Schwanz et al. | 292/127 |
| 3,024,053 | 3/1962 | Cox et al. | 292/21 |
| 3,083,560 | 4/1963 | Scott | 70/92 |
| 3,097,007 | 7/1963 | Eichacker et al. | 292/92 |
| 3,206,656 | 9/1965 | Musgrave | 317/172 |
| 3,228,069 | 1/1966 | Frueh | 20/23 |

(List continued on next page.)

FOREIGN PATENT DOCUMENTS

| | | |
|---|---|---|
| 65418 | 11/1982 | European Pat. Off. . |
| 182751 | 5/1986 | European Pat. Off. . |
| 8300523 | 2/1983 | World Int. Prop. O. . |

*Primary Examiner*—Eric K. Nicholson

*Attorney, Agent, or Firm*—Willian Brinks Olds Hofer Gilson & Lione

[57] ABSTRACT

A panic exit device has an improved linkage between the push bar and the push bar housing so that no significant horizontal or sideways movement of the push bar occurs as it is pushed inward to unlatch the door. Each linkage employs a link having one linear and one curved slot to smoothly guide the push bar whenever the push bar is pressed inwardly. The device further features a fail-safe dogging mechanism so that the push bar cannot be unintentionally dogged. A fail-safe clip is moved out of an interfering position with the dogging element only when the push bar is moved to unlatch the door.

30 Claims, 7 Drawing Sheets

U.S. PATENT DOCUMENTS

| | | | |
|---|---|---|---|
| 3,432,631 | 3/1969 | Deutscher et al. | 200/61.67 |
| 3,464,728 | 9/1969 | Ruckel et al. | 292/92 |
| 3,521,921 | 7/1970 | Miyazaki | 292/201 |
| 3,576,119 | 4/1971 | Harris | 70/271 |
| 3,583,740 | 6/1971 | Armstron | 292/198 |
| 3,614,145 | 10/1971 | Zawadzki | 292/92 |
| 3,636,740 | 1/1972 | Rollins | 70/92 |
| 3,663,047 | 5/1972 | Zawadzki | 70/92 |
| 3,731,963 | 5/1973 | Pond | 292/144 |
| 3,743,898 | 7/1973 | Sturman | 317/154 |
| 3,751,086 | 8/1973 | Geringer | 292/144 |
| 3,753,316 | 8/1973 | Savarieau et al. | 49/31 |
| 3,767,238 | 10/1973 | Zawadski | 292/21 |
| 3,776,582 | 12/1973 | Balducci | 292/92 |
| 3,788,687 | 1/1974 | Zawadzki | 292/92 |
| 3,805,451 | 4/1974 | Miller | 49/394 |
| 3,819,213 | 6/1974 | Vanderburgh | 292/21 |
| 3,854,763 | 12/1974 | Zawadzki et al. | 292/201 |
| 3,869,159 | 3/1975 | Eads | 292/92 |
| 3,877,262 | 4/1975 | Williams | 70/92 |
| 3,935,614 | 2/1976 | Pannone et al. | 16/48.5 |
| 3,973,744 | 8/1976 | Hintzman | 244/137 P |
| 4,006,471 | 2/1977 | Pappas | 340/274 |
| 4,081,980 | 4/1978 | Hightower | 70/92 |
| 4,102,161 | 7/1978 | Proefrock | 70/42 |
| 4,130,306 | 12/1978 | Brkic | 292/5 |
| 4,167,280 | 9/1979 | Godel et al. | 292/92 |
| 4,181,335 | 1/1980 | Thoren | 292/92 |
| 4,185,859 | 1/1980 | Cunningham | 292/93 |
| 4,225,163 | 9/1980 | Hubbard et al. | 292/21 |
| 4,257,631 | 3/1981 | Logan, Jr. | 292/251.5 |
| 4,324,425 | 4/1982 | Logan | 292/201 |
| 4,327,344 | 4/1982 | Luckenbach | 335/253 |
| 4,328,985 | 5/1982 | Logan | 292/201 |
| 4,384,738 | 5/1983 | Floyd | 292/92 |
| 4,427,223 | 1/1984 | Godec et al. | 292/92 |
| 4,437,693 | 3/1984 | Godec | 292/91 |
| 4,439,808 | 3/1984 | Gillham | 361/144 |
| 4,458,928 | 7/1984 | Hirshbein | 292/92 |
| 4,466,643 | 8/1984 | Godec et al. | 292/21 |
| 4,488,378 | 12/1984 | Symon | 49/141 |
| 4,491,354 | 1/1985 | Williams | 292/148 |
| 4,501,203 | 2/1985 | Lyngstrup | 109/635 |
| 4,506,407 | 3/1985 | Downey | 16/48.5 |
| 4,509,347 | 4/1985 | Young | 70/129 |
| 4,540,707 | 9/1985 | Klasen et al. | 70/92 |
| 4,545,606 | 10/1985 | Vodra | 292/92 |
| 4,546,628 | 10/1985 | Takasaki | 292/92 |
| 4,573,238 | 3/1986 | Phillips | 16/79 |
| 4,598,494 | 7/1986 | Tsuji et al. | 49/2 |
| 4,598,939 | 7/1986 | Krupicka et al. | 292/92 |
| 4,601,499 | 7/1986 | Kim | 292/36 |
| 4,624,490 | 11/1986 | Miller | 70/92 |
| 4,627,649 | 12/1986 | Leplat | 292/92 |
| 4,631,528 | 12/1986 | Handel et al. | 340/545 |
| 4,656,690 | 4/1987 | Katagiri et al. | 16/48.5 |
| 4,680,891 | 6/1987 | Perkins | 49/280 |
| 4,709,950 | 12/1987 | Zortman | 292/92 |
| 4,715,146 | 12/1987 | Atsumi et al. | 49/1 |
| 4,741,563 | 5/1988 | Cohrs | 292/21 |
| 4,747,629 | 5/1988 | Miller | 292/92 |
| 4,785,286 | 11/1988 | Martin | 292/92 |
| 4,796,931 | 1/1989 | Neid | 292/92 |
| 4,801,163 | 1/1989 | Miller | 70/92 |
| 4,839,988 | 6/1989 | Betts et al. | 292/92 |
| 4,865,367 | 9/1989 | Choi | 292/92 |
| 4,875,722 | 10/1989 | Miller et al. | 292/92 |
| 4,927,193 | 5/1990 | Miller | 292/92 |
| 4,961,330 | 10/1990 | Evans | 292/91 |
| 4,968,070 | 11/1990 | Choi | 292/92 |
| 4,976,476 | 12/1990 | Cross et al. | 292/92 |
| 5,011,199 | 4/1991 | Lowe et al. | 292/92 |
| 5,016,927 | 5/1991 | Toledo | 292/92 |

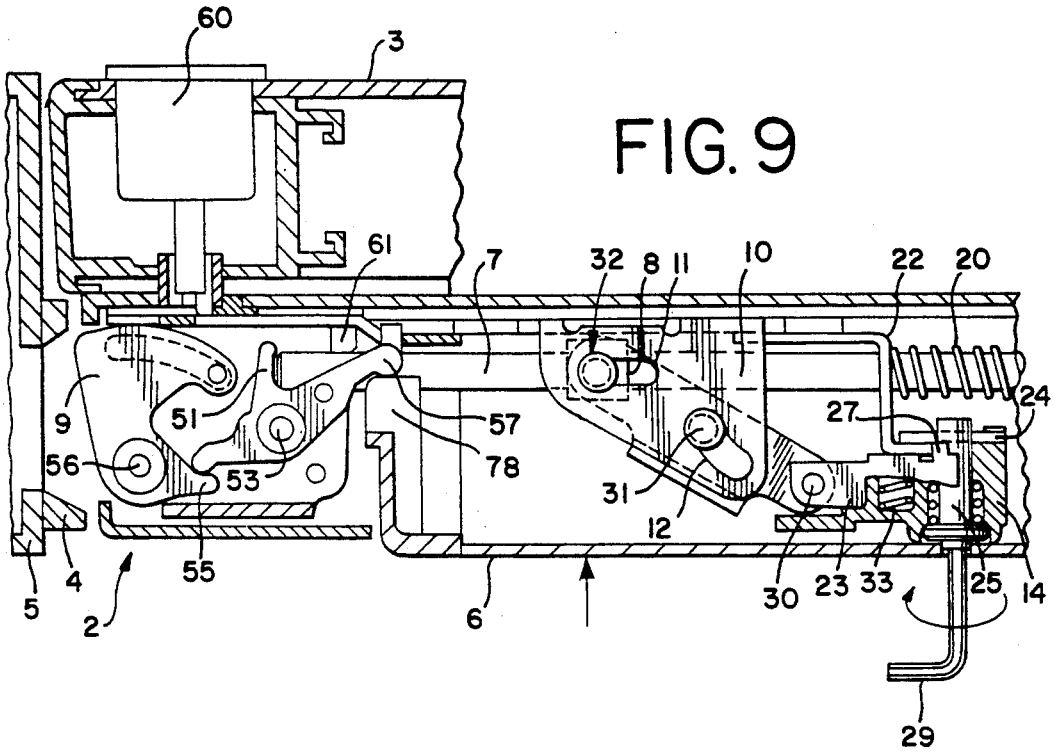
FIG. 9
FIG. 10
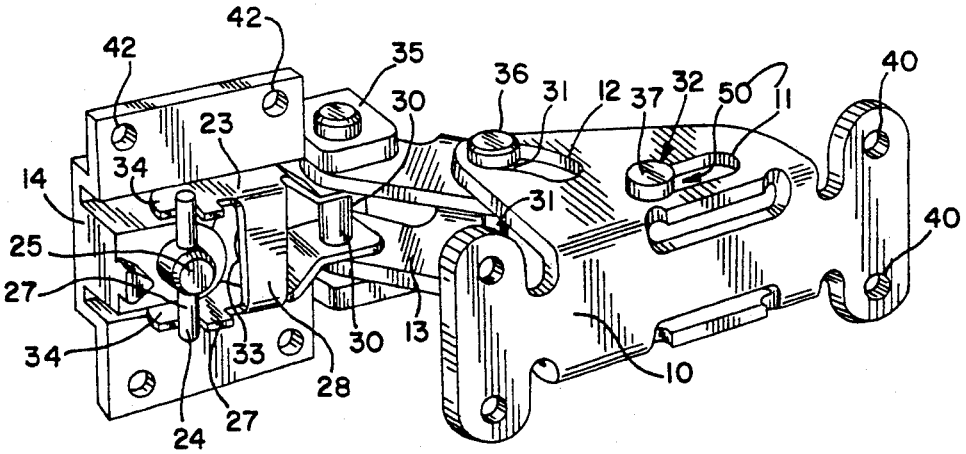

PANIC EXIT DEVICE FEATURING IMPROVED BAR MOVEMENT AND FAIL SAFE DOGGING

This application is a continuation of application Ser. No. 07/645,827, filed Jan. 25, 1991, now abandoned.

FIELD OF THE INVENTION

The invention generally relates to a panic exit device of the kind that is typically mounted at waist height on a door. More particularly, the invention relates to a mechanism for improved movement of a push bar for such a device, and a dogging mechanism for the bar.

BACKGROUND OF THE INVENTION

Panic exit devices of the type to which the invention relates commonly incorporate a push plate or bar spanning the width of the doorway which is pushed to unlatch and swing the door open. The devices translate the inward (and outward) movement of the push bar to throw the door latch.

By their name, the devices are typically used on doors of emergency exits, such as emergency escape doors, or doors which are used to allow the passage of large crowds, such as in a gymnasium. The dependable and quick operation of these devices is obviously crucial.

Panic exit devices using a push plate are shown in Folger, U.S. Pat. No. 4,083,590, and Zawadzki, U.S. Pat. No. 3,730,574, for example. Such devices often resorted to complicated mechanisms to provide for the orthogonal (or rectilinear) movement of the push bar no matter where the bar might be pushed, in order to assure release of the latch. Moreover, because these devices were of more complex construction, they were generally subject to greater maintenance.

It is accordingly desirable that the panic exit device operate consistently, that it be durable, and as non-complex as possible to assure consistent and durable operation.

In panic exit devices, it is also advantageous to provide for the device to be dogged, i.e., secured, in the unlatched position. This is especially important when the door is subjected to substantial traffic, such as a door in a gymnasium, arena and the like, where the door may need to be kept open or unlatched for long periods of time. Zawadzki, U.S. Pat. No. 3,730,574, shows a dogging mechanism for a panic exit device.

It is desirable, however, to prevent the panic exit device from becoming unintentionally dogged, particularly when latched. If this occurred, it then may become impossible to unlatch the door without first undogging the door. Obviously, a door in such a condition could present a serious safety problem.

SUMMARY OF THE INVENTION

The present invention comprises a panic exit device which has an improved linkage between a push bar and latch mechanism. The novel linkage includes a lever housing having two slots: a first slot which is linear and parallel to the movement of the latch actuator, and a second slot which is curved i.e., kidney-shaped, and not parallel to the latch actuator.

In a disclosed embodiment, the lever housing is fixed to a push bar housing. A connecting lever link extends from the lever housing to a bracket on the push bar. One end of the link is pivotably attached to this bracket. The opposite end of the link has a pin that is slidably engaged in the first linear slot on the lever housing. Another pin on the lever link, approximately midway between its ends, is pivotably and slidably engaged in the second curved slot on the lever housing.

Two such linkage assemblies are used with the push bar. Through this relatively uncomplicated connection, the push bar is securely and dependably mounted to the push bar housing so as to allow consistent inward and outward rectilinear motion of the push plate relative to the door without any significant accompanying horizontal translation.

Additionally, the aforementioned bracket has mounted within it a dogging axle for a dogging feature. Extending from the dogging axle is a dogging pin which, when rotated into position, engages a dogging catch mounted to the push bar housing to secure the exit device in an unlatched position, i.e., to dog the push bar inwardly. Mounted to the dogging bracket is a pivoting fail-safe clip. The clip is biased to ordinarily engage the dogging pin to prevent rotation of the axle, but is pivoted out of engagement when the push bar is pushed in and the door is unlatched. This ensures that the device can only be dogged when the push plate is depressed and the door is unlatched.

The present invention therefore provides a simple linkage to ensure the dependable rectilinear movement of the push bar without any appreciable accompanying sideways motion. A simple but effective fail-safe dogging mechanism that assures the device can only be dogged when the door is in the unlatched position is also provided. The dangerous condition of a latched and dogged door thus should not occur.

The foregoing features and advantages of the invention will be further understood upon consideration of the following detailed description of two embodiments of the invention, taken in conjunction with the drawings, in which:

BRIEF DESCRIPTION OF THE FIGURES

FIG. 9 is an enlarged view similar to that of FIG. 4 with the push bar pushed inward toward the door, and the device dogged;

FIG. 10 is a perspective view of the inventive linkage (as seen looking outwardly from the door);

DETAILED DESCRIPTION OF TWO PREFERRED EMBODIMENTS

Figure 1:
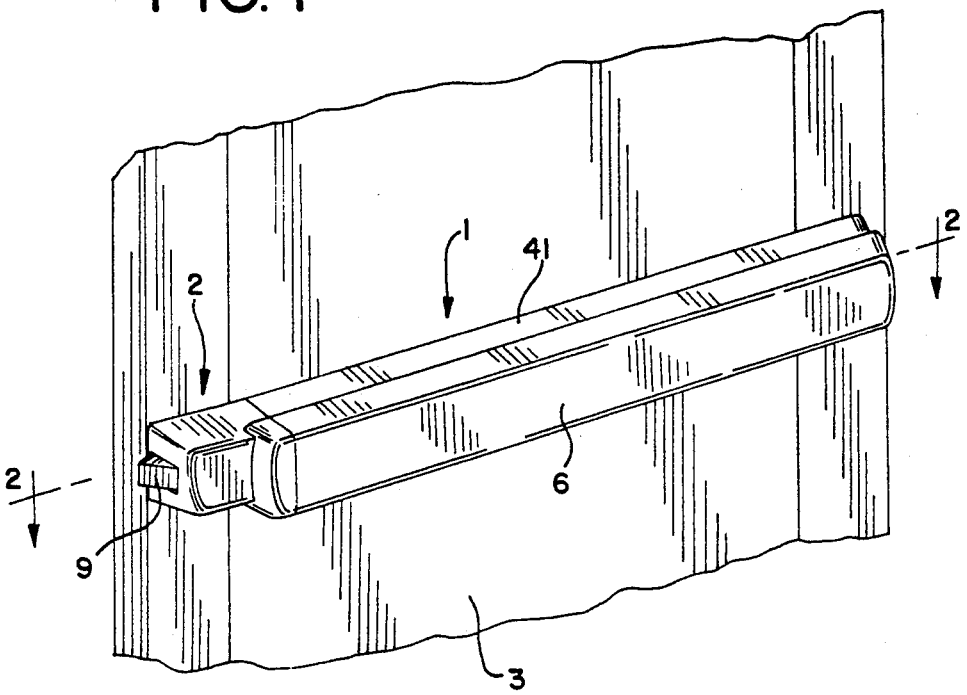
FIG. 1 is a perspective view of a panic exit device made in accordance with the invention in use with a rim latch assembly, and mounted to a door.
Figure 5:
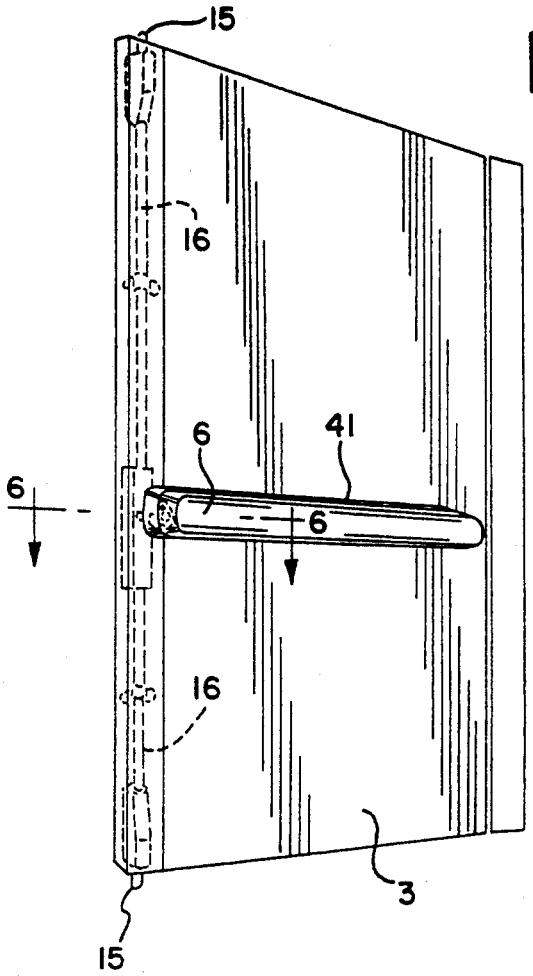
FIG. 5 is a perspective view of another embodiment of the device made in accordance with the invention in use with a vertical rod latch assembly, and mounted to a door.

FIG. 1 shows a first embodiment of a panic exit device 1 in use with a rim latch assembly 2 and mounted to a door 3. The device 1 is mounted horizontally on the door 3 at about waist height. The device may be used in conjunction with other latch assemblies, typically either a rim latch, as shown in FIG. 1, or a vertical rod latch assembly as shown in FIG. 5. Also, while shown herein as mounted exterior to the door, the invention can be adapted to be mounted within the door body.

Figure 2:
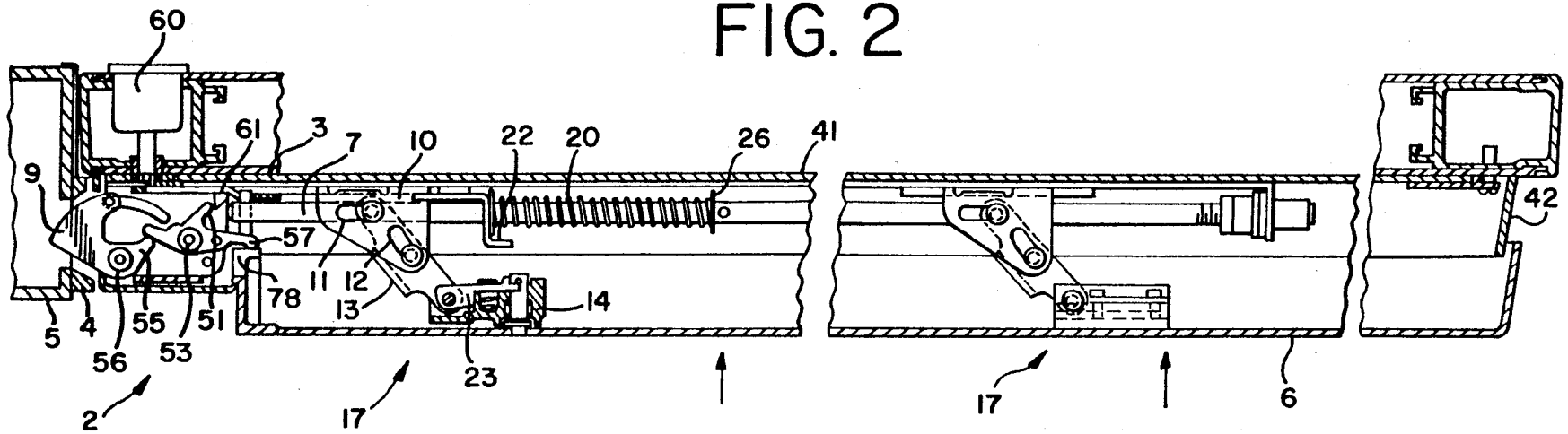
FIG. 2 is an enlarged sectional view of the device taken along line 2—2 of FIG. 1.

The basic operation of the panic exit device consists of pushing a push bar or plate 6 inward, or towards the door (in the direction of the arrows of FIG. 2). Through a pair of innovative linkages 17, the inward movement of the push bar 6 is smoothly translated, thereby allowing the door 3 to be opened. Moreover, the linkages provide the same smooth rectilinear movement regardless of where the push bar is pressured, i.e., the door can be readily unlatched even when only one end of the bar 6 is pushed.

The Linkage Assembly

One significant feature of the claimed invention is this reliable movement of the push bar 6 as achieved by the novel linkage. Through this feature, very little sideways clearance is required between the push plate and the push bar housing 41. This orthogonal (or rectilinear) translation of the push bar motion is achieved largely through the unique slot configuration on a lever housing 10 which is used to connect the push bar 6 to the actuator rod 7 via the activating lever link 13 and (dogging) bracket 14.

As noted, two linkage assemblies 17 are used to mount the push bar 6. Through this configuration and the interconnection provided by the actuator rod 7, the dual linkage assemblies 17 ensure that the entire push bar 6 will be moved inward from pressure at any location on its face. Only one linkage assembly will be described in detail, however, since they are identical.

Figure 4:
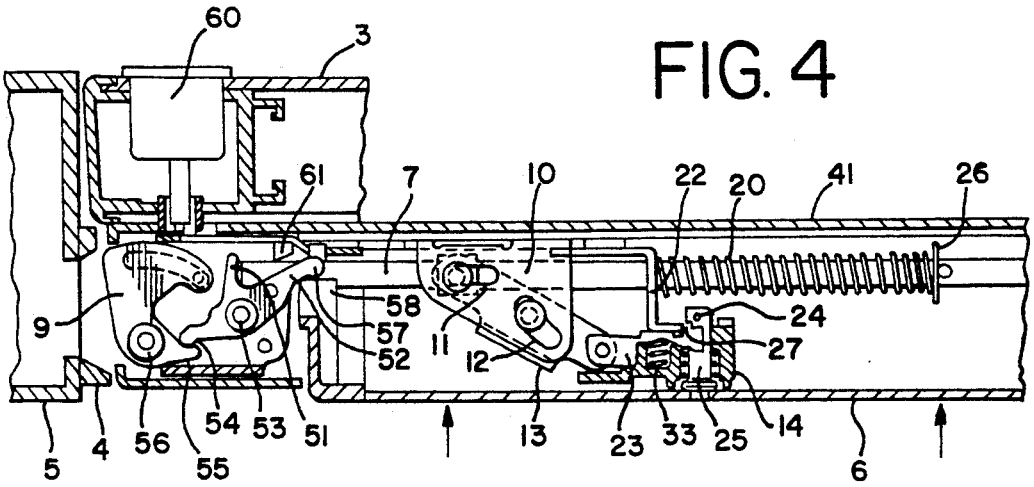
FIG. 4 is an enlarged view similar to that of FIG. 2 showing the end having the rim latch assembly with the push bar pushed inward (or towards the door) so that the door is unlatched.
Figure 11:
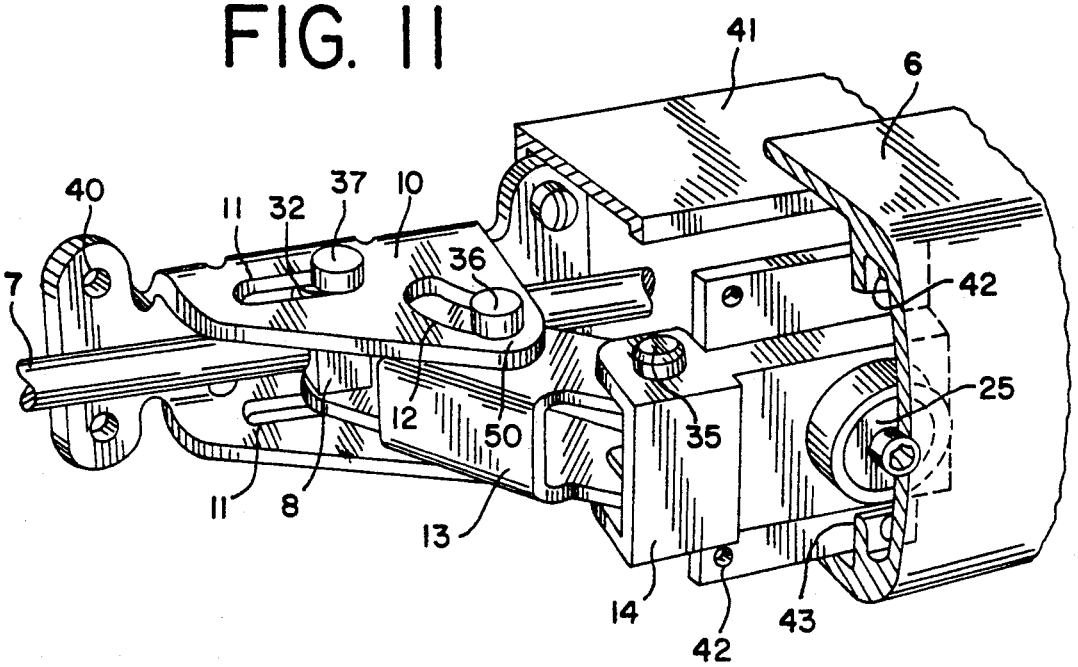
FIG. 11 is a cutaway perspective view of the linkage of FIG. 10 with the push bar undepressed.
Figure 12:
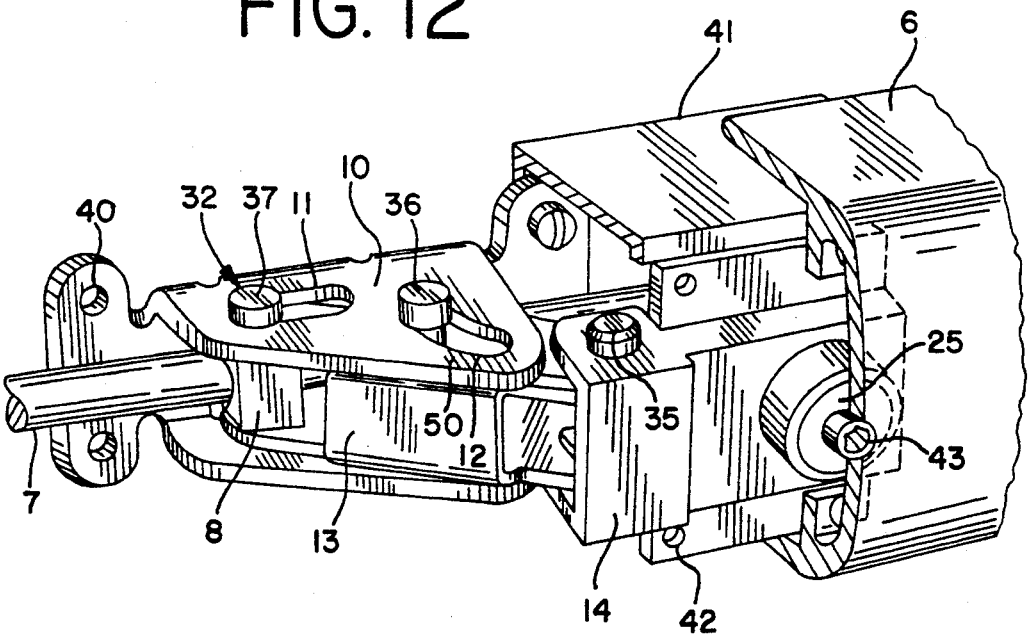
FIG. 12 is a view similar to that of FIG. 11 with the push bar pushed inward.

How these two slots provide for the linear movement of the push bar can be best seen, for example, in FIGS. 2, 4, 11 and 12. FIG. 2 is an enlarged sectional cutaway top view of the device when latched, i.e., the push bar 6 is not pushed in. FIG. 11 shows a cutaway perspective detail of the linkage when the door is in the same condition (i.e., latched). FIGS. 4 and 12 show the position of the same corresponding elements with the push bar 6 pushed in (i.e., unlatched).

As seen in FIG. 2, the push bar 6 is extended outward from the door face. The push bar 6 is biased to its outward position by a coil spring 20 mounted concentric with rod 7. One end of the spring 20 bears against a retaining ring 26 which is fixed to the rod 7. The other end of the spring 20 engages a dogging catch 22 which is fixed to the push bar housing 41. The rod 7 passes through an aperture in the dogging catch 22. The spring 20 thereby biases the actuator rod 7 to the right, as viewed in FIG. 2. This in turn biases the push bar 6 outwardly as shown in FIG. 2. While the novel linkage assembly 17 will be described in more detail immediately hereafter, it can nonetheless be seen that rod 7 is fixed to linkage 17 via pin 32, and movement of the rod 7 to the right therefore moves the push bar 6 outwardly.

As shown in FIG. 4, when the push bar 6 is inward, or near the door face 3, one end of a link 13 has pivoted about pin 30 on the (dogging) bracket 14. The opposite end of the link 13 has been guided by linear slot 11 on the lever housing via pin 32 in a direction parallel to the rod 7. The mid-point of link 13 is guided by curved slot 12 via pin 31 along a curved path so as to allow the actuator rod-end of link 13 to move in a linear fashion without any sideways motion of the push bar 6. Thus, through this linkage configuration, and as can be seen by comparing FIGS. 2 and 11 with 4 and 12, the inward and outward motion of the push bar is perpendicular to the door 3, but translated to move the end of link 13 at its pin 32 in a path parallel to the axis of the latch actuator rod 7, thereby moving the rod 7 in a like path.

Figure 3:
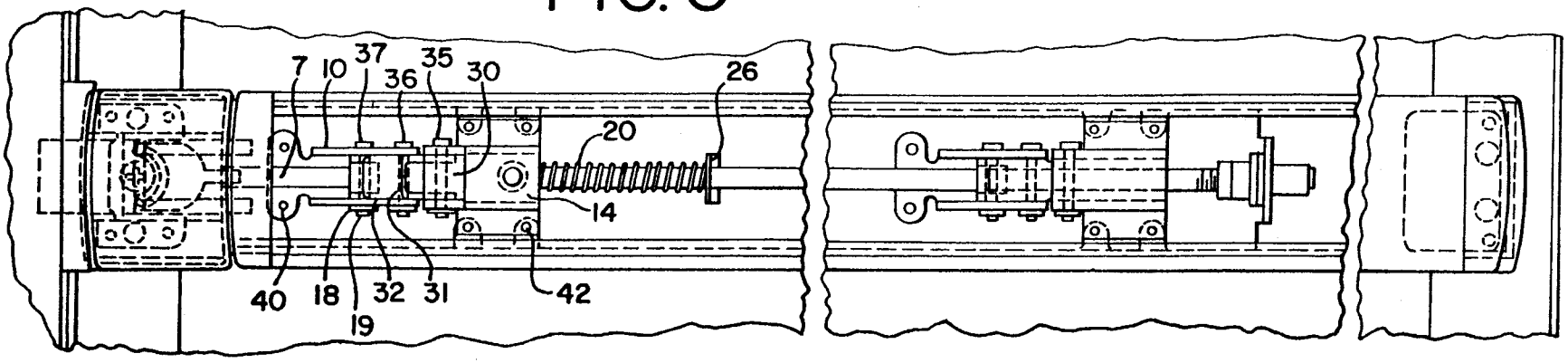
FIG. 3 is a front elevational view of the device of FIG. 2, with portions exposed for clarity.

Turning now to the linkage assembly 17 in more detail, the lever housing 10 is mounted to push bar housing 41 through mounting holes 40 with screws, bolts or the like. As already described, slot 11 in the lever housing 10 is substantially parallel to the actuator rod 7, while curved slot 12 is not parallel to the actuator rod 7, and is generally kidney shaped. One end of the link 13 is pivotably and slidably mounted within the linear slot 11 via pivot pin 32. Pivot pin 32 has a head 37 with a larger diameter than the linear slot 11, and is held in place by a ring washer 18 and retaining washer 19 on its opposite end, as seen in FIG. 3. A spacer bearing 8 is used to connect, via pin 32, link 13 to rod 7.

At approximately the midpoint of the link 12 is pivot pin 31. Pivot pin 31 is constructed having a head 36 with a diameter about equal to the width of curved slot 12. A ring washer 18 and a retaining washer 19 are also provided on the opposite end of pin 31, as seen in FIG. 3. Pivot pin 31 is slidably mounted within the non-linear slot 12 on a roller 50, as seen in FIGS. 11 and 12. Head 36 and roller 50 are sized larger than the hole in link 13 through which the pin 31 extends, so as to retain this end of pin 31 in place.

The other end of the link 13 is pivotally mounted to the dogging bracket 14 by pivot pin 30. Pivot pin 30 has a head 35 of larger diameter than the hole in the dogging bracket through which the pin extends. A ring 18 and retaining washer 19 combination locates the other end of pin 30 in place, again as seen in FIG. 3. The dogging bracket 14 is in turn fixed to the push plate 6 through screws, bolts or the like used with mounting holes 42.

Figure 13:
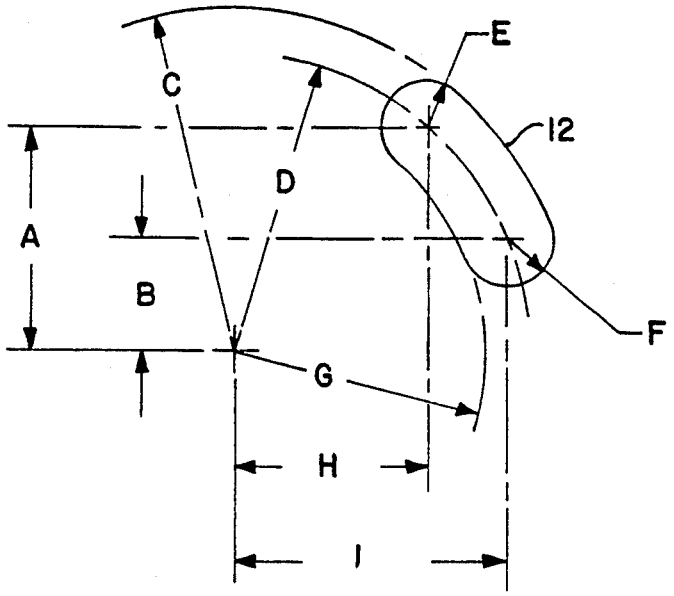
FIGS. 13 and 14 illustrate the various dimensions and spacial relationship of the slots used in the novel linkage.
Figure 14:
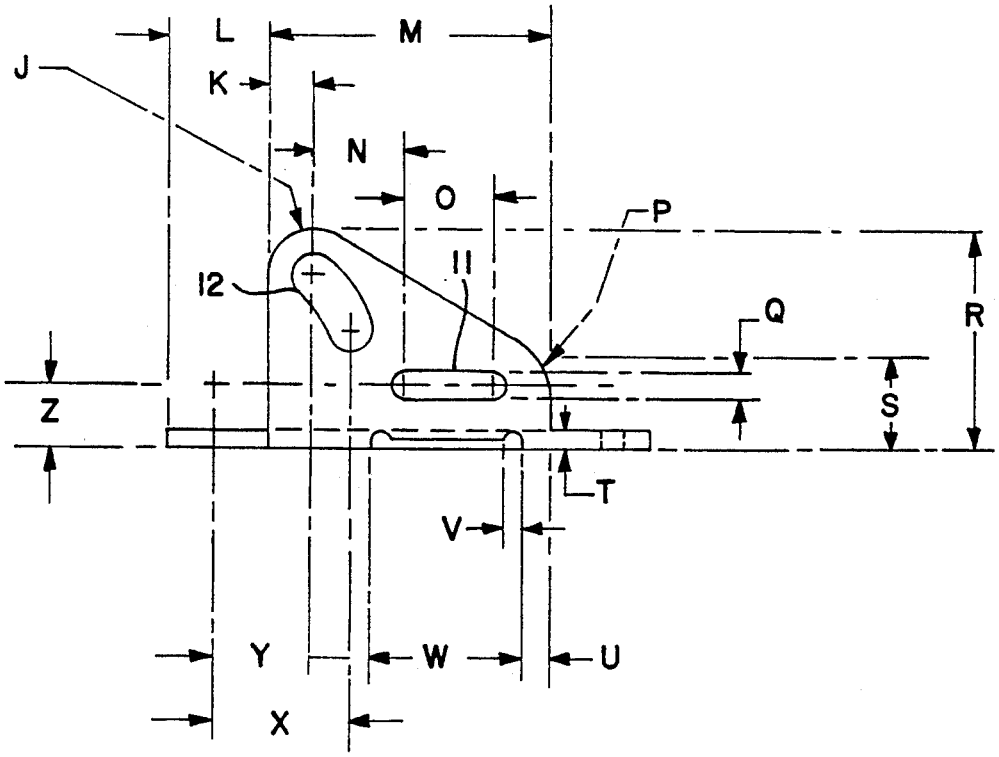

Curved slot 12 has a radius of curvature along its midline of about one inch, as shown in FIG. 13 (which is at twice scale size). FIG. 14 illustrates to scale the orientation and size of slots 11 and 12 of the lever housing 13.

Specifically, the dimensions of the slots 11 and 12 shown in FIGS. 13 and 14 are as follows: A is 0.752 inches; B is 0.377 inches; C is 1.157 inches; D is 1.000 inches; E is between 0.157 and 0.162 inches; F is between 0.157 and 0.162 inches; G is 0.843 inches; H is 0.659 inches; I is 0.926 inches; J is 0.281 inches; K is 0.281 inches; L is 0.688 inches; M is 1.880 inches; N is 0.625 inches; O is 0.593 inches; P is 0.50 inches; Q is between 0.192 and 0.195 inches; R is 1.500 inches; S is 0.620 inches; T is 0.062 inches; U is 0.19 inches; V is 0.125 inches; W is 1.00 inches; X is 0.926 inches; Y is 0.659 inches; and Z is 0.437 inches.

In the embodiment depicted in FIG. 2 the device is shown in use with a rim latch assembly to latch the door. The rim latch generally operates as follows: When the push bar 6 is pushed inward, its latch actuator end-cap portion 78 also is moved and strikes the pivot lever 52 at a ball end 57. This rotates the pivot lever 52 counter-clockwise about pin 53, thereby moving an end spur 54 relatively outwardly. The end spur 54 on the pivot lever 52 engages with a latch spur 55 on the latch 9 causing it to rotate about pin 56 in a clockwise direction and unlatch the door. The rim latch further features a capability of also being unlatched from outside the door, i.e., from the side opposite the push bar 6. Specifically it has a lock cylinder 60 which is linked to a pivot gear actuator 61. The feature is designed so that the lock cylinder 60 is turned, usually by a corresponding key, the pivot gear actuator 61 moves to the left and engages the pivot lever 52 at its midspur 51 to unlatch the door. Further details concerning the rim latch assembly are well within the skill of those in the art. The type of latch mechanism used forms only a general environment for the invention.

Figure 8:
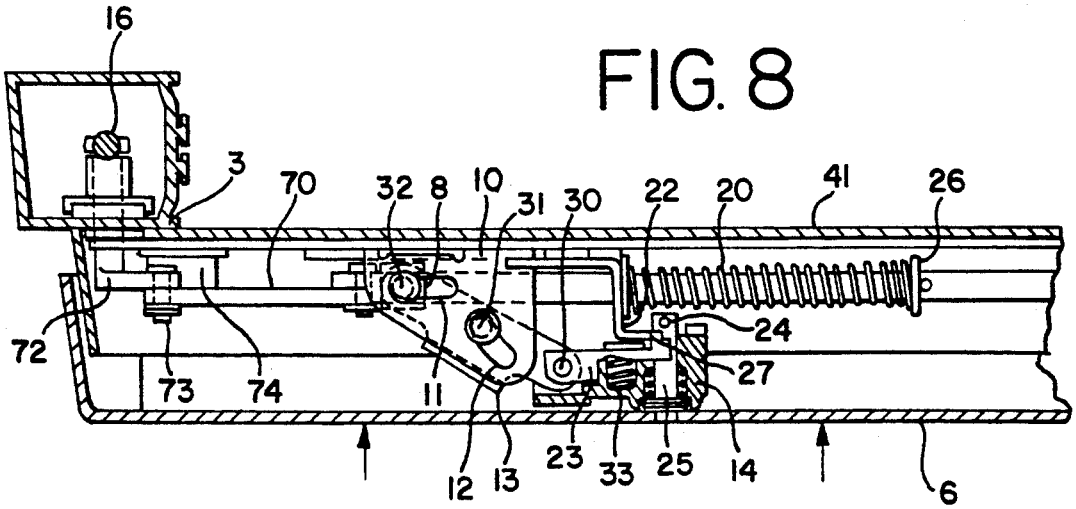
FIG. 8 is a view similar to that of FIG. 6 showing the end having the vertical rod latch assembly in the unlatched position.
Figure 6:
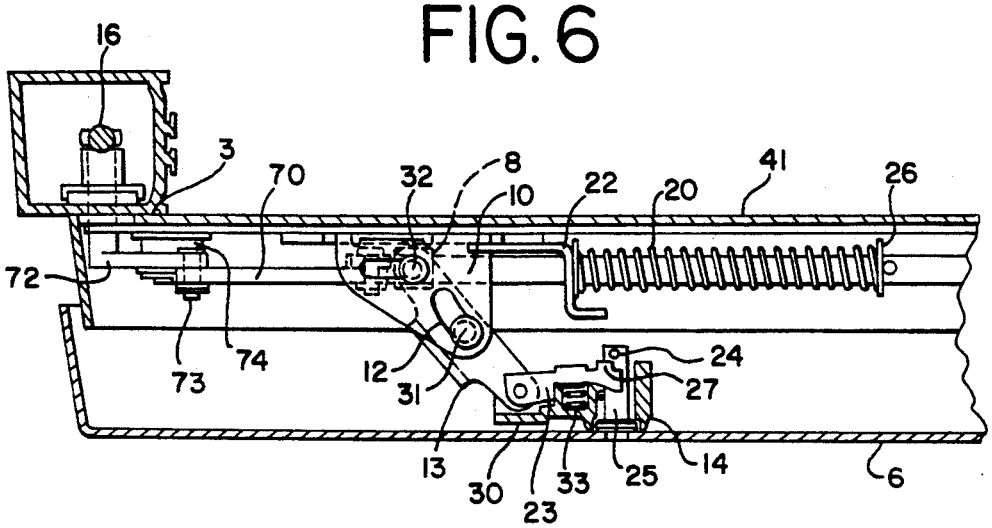
FIG. 6 is an enlarged sectional view of the device taken along line 6—6 of FIG. 5.
Figure 7:
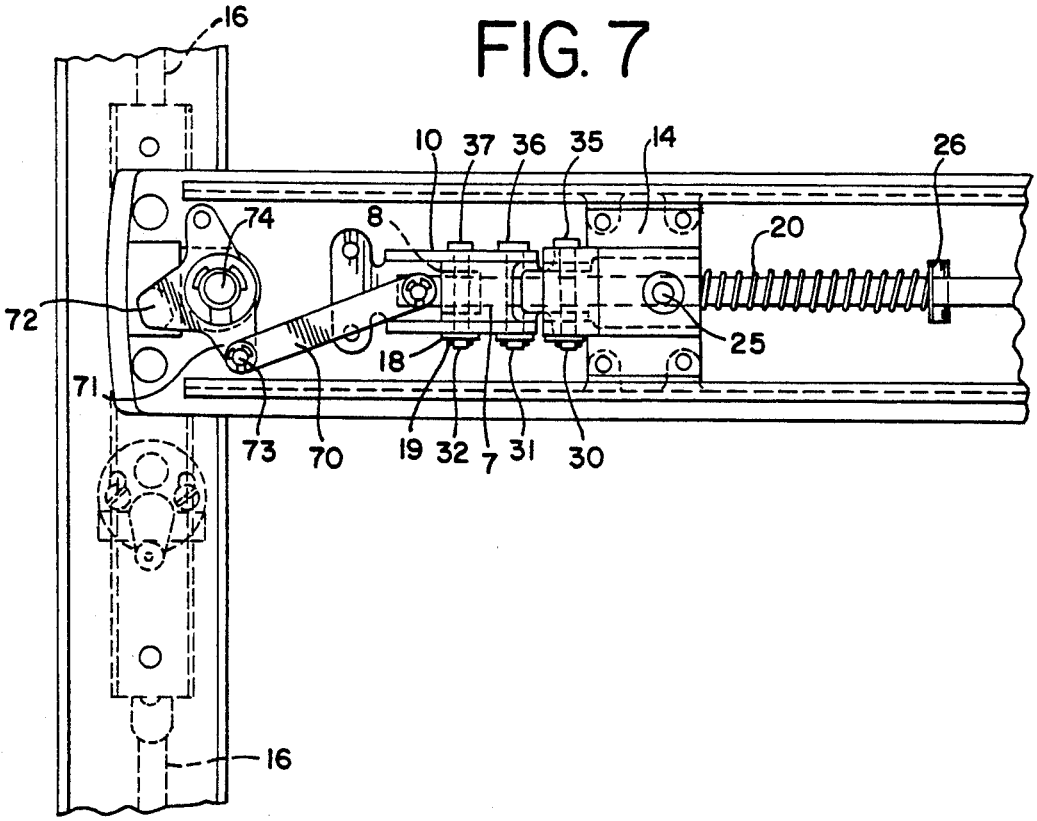
FIG. 7 is a front elevational view of the device of FIG. 6, with portions exposed for clarity.

In another embodiment, the translation of the inward and outward movement of the push bar 6 to unlatch a door using a vertical rod latch assembly can be seen in FIGS. 5–8. The elements and motion of the linkage mechanisms 17 are identical to the device when used with the previously described rim latch assembly, except that a slightly shorter actuator rod 7 is used. As when the device is used with a rim latch assembly, the actuator rod 7 is moved to the left by the inward movement of the push bar 6, as seen in FIG. 8. When used with a vertical rod latch assembly, however, the actuator rod 7 is connected to a crank 70. The crank 70 is further connected to an arm of a bell crank 72 by a pin 73. The bell crank is mounted to pivot about a pin 74. The bell crank 72 is further connected to a mechanism, such as that disclosed in Miller, U.S. Pat. No. 4,295,673, to effect a releasing movement to the vertical rods 16.

The Fail-Safe Dog

As can be best seen in FIGS. 9 and 10, the device 1 further incorporates a fail-safe dogging feature so that the device can only be dogged when in an unlatched condition. Specifically, a fail-safe clip 23 is pivotally mounted at one end on the pin 30. The clip 23 is biased by a compression spring 33 into a position away from the dogging bracket 14.

The clip 23 has a pair of spaced apart fingers 34. These fingers 34 engage the ends of a dogging pin 24 with stops 27 formed on the fingers that normally prevent rotation of the dogging axle 25. Axle 25 is mounted for rotation in a bore (of a dogging cylinder) in the dogging bracket 14. A noteworthy feature of the preferred embodiment is that this rotation can be in either a clockwise or counterclockwise direction to dog the device. This feature allows the device to be dogged by the operator in whichever direction is preferred. This also allows the same fail safe dog to have interchangeable use between left or right-hand mountings. A rigid web 28 extends between the fingers 34. Spring 33 bears against the inboard side of this web.

The fail-safe dogging feature works as follows: when the push bar 6 is in its resting position, i.e., biased outward by the spring 20, the clip 23 is biased by the spring 33 so that the stops 27 engage and extend into the path of rotation of the dogging pin 24. This prevents the dogging axle 25 from being rotated into a dogged position. If the dogging cylinder 25 was rotated while the door is still latched, the door could not be unlatched by simply pushing the push plate 6, since the dogging pin 24 would strike the catch 22 and prevent the push plate from being moved sufficiently inward to unlatch the door.

When the push bar 6 is pushed inward and the latch 9 retracted, the device is as shown in FIG. 9. As seen, the push bar 6 has been moved towards the door 3 as far as possible. The dogging bracket 14, mounted to the push bar 6, has likewise been moved towards the door 3 so that the web 28 of the fail-safe clip 23 now contacts the catch 22. At this time, the bias provided to the clip 23 by the spring 33 is overcome by the catch 22 pressing the web 28 against the bias. With clip 23 thereby pivoted toward the push bar 6, the stops 27 of the fingers 34 are clear of the path of rotation of the dogging pin 24. Only when this occurs can the dogging cylinder 25 be rotated into a dogged position, as shown in FIG. 9, through rotation of the axle 25 by a hex or Allen wrench 29. Thus, this feature ensures that the push bar 6 cannot be inadvertently, or even intentionally, dogged unless the door is already unlatched.

From the foregoing it is evident that the claimed invention is a novel panic exit device featuring fail-safe dogging, and a simple but effective linkage to translate the linear inward and outward motion of the push bar to a relatively sideways motion of the latch actuator.

Thus while the invention has been described in relation to particular embodiments, those having skill in the art will recognize modifications of materials, structure and the like which will still fall within the scope of the present invention.

I claim:

1. A panic exit device for a door comprising:

a latch movable between latched and unlatched positions, a latch actuator mounted for movement between a first position wherein said latch is latched to a second position wherein said latch is unlatched, means providing an operative connection between said latch and latch actuator for said latch movement, a panic bar having a length extending generally parallel to the plane of the door, means for mounting said panic bar for inward and outward movement along its length relative to said door and for operatively connecting said panic bar to said latch actuator such that said inward and outward movement of said panic bar relative to said door causes said latch actuator to move between said first and second positions, said means for mounting including a lever link having a first end pivotally attached to a mount fixed to one of said door and said panic bar, an opposite end mounted to the other of said door and said panic bar for slidable movement in a direction substantially orthogonal to said inward and outward movement of said panic bar, and means located between said link ends for causing a point on said lever link between said first end and said second end to follow an arcuate path to effect said orthogonal slidable movement upon said inward and outward movement of said panic bar.

2. The panic exit device of claim 1 wherein said means for mounting further comprises a lever link bracket for mounting said opposite end of said link, said link bracket having a linear slot defined therein within which a first pin on said opposite end is slidable received, and wherein said means for causing said point to follow an arcuate path comprises an arcuate slot defined in said link bracket within which is slidably received a second pin extending from said link.

3. The panic exit device of claim 2 wherein said second pin is located at a point about midway along a line extending between a pivot point for said first link end and said first pin.

4. A panic exit device for a door comprising:

a housing, a latch movable between latched and unlatched positions, a latch actuator mounted within said housing for movement between a first position wherein said latch is extended and a second position wherein said latch is retracted, means providing an operative connection between said latch and latch actuator for said latch movement, a panic bar having a length extending generally parallel to the plane of the door, a pair of spaced apart mounting assemblies mounting said panic bar to said housing for rectilinear movement along its length relative to said housing and for operatively connecting said panic bar to said latch actuator such that inward and outward movement of said panic bar relative to said housing causes said actuator to move between said first and second positions, each of said mounting assemblies including a lever link having a first end pivotally attached to a mount fixed to one of said housing and said panic bar, an opposite end mounted to the other of said housing and said panic bar for slidable movement in a direction substantially orthogonal to said rectilinear movement, and means located between said link ends for causing a point on said lever link between said first end and said second end to follow an arcuate path to effect the translation of said rectilinear movement of said panic bar into said slidable movement of said opposite end of said lever link.

5. The panic exit device of claim 4 wherein said mounting assemblies further comprises a lever link bracket for mounting said opposite end of said link, said link bracket having a linear slot defined therein within which a first pin on said opposite end is slidable received, and wherein said means for causing said point to follow an arcuate path comprises an arcuate slot defined in said link bracket within which is slidably received a second pin extending from said link, said second pin being located at a point about midway along a line extending between a pivot point for said first link end and said first pin.

6. A panic exit device for a door comprising:

an elongated housing, a latch movable between latched and unlatched positions, a latch actuator mounted within said housing for movement between a first position wherein said latch is extended and a second position wherein said latch is retracted, said extended and retracted positions corresponding to said latched and unlatched positions, respectively, means providing an operative connection between said latch and latch actuator for said latch movement, a panic bar having a length extending generally parallel to said housing, a part of spaced apart mounting assemblies mounting said panic bar to said housing for rectilinear movement along its length relative to said housing and for operatively connecting said panic bar to said latch actuator such that inward and outward movement of said panic bar relative to said housing causes said actuator to move between said first and second positions, each of said mounting assemblies including a lever link having first and second ends, a link mount fixed to said panic bar, and a link bracket fixed to said housing, said first link end pivotally attached to said link mount, said second link end mounted in a linear slot defined in said link bracket for slidable movement in a direction substantially orthogonal to said rectilinear movement, with an arcuate slot defined in said link bracket within which is slidably received a pin located on said link between said link ends, said arcuate and linear slots being adapted to cause said pin on said lever link between said first link end and said second link end to follow an arcuate path and said second link end to follow a linear path to effect said slidable movement.

7. A dogging safety mechanism for a panic exit device having a housing with a push bar mounted to the housing and movable relative to the housing to unlatch a door latch, comprising:

a rotatable dogging element movable from an undogged position to a dogged position, a dogging pin carried by said dogging element to effect said dogging, a clip mounted for movement from a first position in which said clip engages said pin and prevents rotation of said dogging element to said dogged position, to a second position in which said clip is disengaged from said pin and does not prevent rotation of said dogging element to said dogged position, a dogging catch mounted for engagement by said dogging pin to dog said push bar, said dogging catch engaging said clip and moving said clip from said first position to said second position upon movement of said push bar to unlatch the door latch.

8. The mechanism of claim 7 wherein said dogging element is mounted for both clockwise and counterclockwise rotation so that said dogging element may be rotated into said dogged position by rotation in either direction.

9. A dogging safety mechanism, comprising:

a first member movable relative to a second member.

means for dogging the first member to the second member when said first member is moved to a doggable position, said dogging means being movable from a first undogged position to a second dogged position, said second dogged position corresponding to a dogged condition of said first member, a dogging safety element mounted for movement from a first position wherein said safety element engages and prevents movement of said dogging means to said second dogged position, to a second position wherein said safety element is disengaged from said dogging means and does not prevent movement of said dogging means to said second dogged position, means for moving said dogging safety element from said first position to said second position upon movement of said first member to said doggable position, said dogging safety element including a clip pivotally mounted to said dogging means to interfere with the movement of the dogging means when the door is latched and not interfere with the movement of the dogging means when the door is unlatched.

10. The dogging safety mechanism of claim 9 wherein said first member is a panic exit bar and said second member is a housing for said bar, said bar unlatching a door latch when in said doggable position.

11. The mechanism of claim 9 wherein said dogging means is mounted for both clockwise and counter-clockwise rotation so that said dogging means may be rotated into said second dogged position by rotation in either direction.

12. A dogging safety mechanism for a panic exit device having a housing with a push bar mounted to the housing and movable relative to the housing to unlatch a door latch, comprising:

means for dogging the push bar relative to the housing to place the push bar in a doggable position, said dogging means mounted to said push bar and being movable from a first undogged position to a second dogged position, said second dogged position corresponding to a dogged condition of the push bar, a dogging safety element mounted for movement from a first position wherein said safety element engages and prevents movement of said dogging means to said second dogged position, to a second position wherein said safety element is disengaged from said dogging means and does not prevent movement of said dogging means to said second dogged position, means for moving said dogging safety element from said first position to said second position upon movement of said push bar to said doggable position wherein said dogging safety element further comprises a clip pivotally mounted to said dogging means where said clip will interfere with the movement of the dogging means when the door is latched and will not interfere with the movement of the dogging means when the door is unlatched.

13. The mechanism of claim 12 wherein said dogging safety element is spring-biased to interfere with the movement of the dogging means when the door is latched, and said means for moving said dogging safety element comprises a rigid member which engages said clip and presses it against aid bias so as to move said clip to said second position wherein it will not interfere with the movement of the dogging means when the door is unlatched.

14. The mechanism of claim 12 wherein said dogging safety element further comprises a clip having a pair of stops, said clip being pivotally mounted to a bracket, with a spring carried by said bracket biasing said clip so that said stops engage with and interfere with the movement of a pin extending radially from opposite sides of a rotatable dogging axle when the door is latched, and said means for moving said dogging safety element comprises a rigid dogging catch having a portion which extends into the path of movement of said clip and engages said clip and presses it against said bias so as to move said clip to said second position wherein it will not interfere with the movement of said pin when the door is unlatched, said pin engaging with another portion of said catch to dog the push bar.

15. The mechanism of claim 12 wherein said dogging means is mounted for both clockwise and counter-clockwise rotation so that said dogging means may be rotated into said second dogged position by rotation in either direction.

16. A dogging safety mechanism for a panic exit device having a push bar mounted for movement relative to a door to unlatch a door latch, comprising:

a rotatable dog mounted to said push bar and movable from an undogged position to a dogged position, a stop mounted for movement from a first position on which said stop engages said dog and prevents rotation of said dog to said dogged position, to a second position in which said stop is disengaged form said dog and does not prevent rotation of said dog to said dogged position, a dogging catch mounted for engagement by said dog to dog said push bar, and means for engaging said stop and moving said stop from said first position to said second position upon movement of said push bar to unlatch the door latch wherein said stop is mounted on a clip having a pair of stops, said clip being pivotally mounted to a bracket with a spring carried by said bracket biasing said clip so that said stops engage with and interfere with the movement of a pin extending radially from opposite sides of said rotatable dog when the door is latched, and said means for engaging and moving said stop comprises a rigid portion of said dogging catch which extends into the path of movement of said clip and engages said clip and presses it against said bias so as to move said clip to said second position wherein said stops will not interfere with the movement of said pin when the door is unlatched, said pin engaging with another portion of said catch to dog the push bar.

17. The mechanism of claim 16 wherein said bracket is mounted on the push bar, and said catch is mounted on a housing which supports said push bar.

18. The mechanism of claim 16 wherein said rotatable dog is mounted for both clockwise and counter-clockwise rotation so that said rotatable dog may be rotated into said dogged position by rotation in either direction.

19. A panic exit device for a latch comprising:

a latch movable between latched and unlatched positions, a latch actuator mounted for movement between a first position wherein said latch is latched to a second position wherein said latch is unlatched, means providing an operative connection between said latch and latch actuator for said latch movement, a panic bar having a length extending generally parallel to the plane of the door, means for mounting said panic bar for rectilinear movement along its length relative to said door and for operatively connecting said panic bar to said latch actuator such that inward and outward movement of said panic bar relative to said door causes said latch actuator to move between said first and second positions, said means for mounting including a lever link having a first end pivotally attached to a mount fixed to one of said door and said panic bar, an opposite end mounted to the other of said door and said panic bar for slidable movement in a direction substantially orthogonal to said rectilinear movement, and means located between said link ends for causing a point on said lever link between said first end and said second end to follow an arcuate path to effect the translation of said rectilinear movement of said panic bar to said slidable movement of said opposite end of said lever link, means for dogging said panic bar when said panic bar is moved inwardly and said latch is unlatched thereby placing said panic bar in a doggable position, said dogging means being movable from a first undogged position to a second dogged position, said second dogged position corresponding to a dogged condition of said panic bar, a dogging safety element mounted for movement from a first position wherein said safety element engages and prevents movement of said dogging means to said second dogged position, to a second position wherein said safety element is disengaged from said dogging means and does not prevent movement of said dogging means to said second dogged position, and means for moving said dogging safety element from said first position to said second position upon movement of said first member to said doggable position.

20. The mechanism of claim 19 wherein said dogging means are mounted for both clockwise and counterclockwise rotation so that said dogging means may be rotated into said second dogged position by rotation in either direction.

21. A panic exit device for a door comprising:

an elongated housing, a latch movable between latched and unlatched positions, a latch actuator mounted within said housing for movement between a first position wherein said latch is extended and a second position wherein said latch is retracted, said extended and retracted positions corresponding to said latched and unlatched positions, respectively, means providing an operative connection between said latch and latch actuator for said latch movement, a panic bar having a length extending generally parallel to said housing, a pair of spaced apart mounting assemblies mounting said panic bar to said housing for rectilinear movement along its length relative to said housing and for operatively connecting said panic bar to said latch actuator such that inward and outward movement of said panic bar relative to said housing causes said actuator to move between said first and second positions, each of said mounting assemblies including a lever link having first and second ends, a link mount fixed to said panic bar, and a link bracket fixed to said housing, said first link end pivotally attached to said link mount, said second link end mounted in a linear slot defined in said link bracket for slidable movement in a direction substantially orthogonal to said rectilinear movement, with an arcuate slot defined in said link bracket within which is slidably received a pin located on said link at a point between said link ends, said arcuate and linear slots being adapted to cause said pin to follow an arcuate path and said second link end to follow a linear path to effect said rectilinear movement, a rotatable dog mounted on said panic bar and movable from an undogged position to a dogged position, a stop mounted for movement from a first position in which said stop engages said dog and prevents rotation of said dog to said dogged position, to a second position in which said stop is disengaged from said dog and does not prevent rotation of said dog to said dogged position, a dogging catch mounted on said housing for engagement by said dog to dog said push bar, and means for engaging said stop and moving said stop from said first position to said second position upon movement of said push bar to unlatch the door latch.

22. The mechanism of claim 21 wherein said rotatable dog is mounted for both clockwise and counterclockwise rotation so that said rotatable dog may be rotated into said dogged position by rotation in either direction.

23. A panic exit device for a door comprising:

an elongated housing, a latch movable between latched and unlatched positions, a latch actuator mounted within said housing for movement between a first position wherein said latch is extended and a second position wherein said latch is retracted, said extended and retracted positions corresponding to said latched and unlatched positions, respectively, means providing an operative connection between said latch and latch actuator for said latch movement, a panic bar having a length extending generally parallel to said housing, a pair of spaced apart mounting assemblies mounting said panic bar to said housing for rectilinear movement along its length relative to said housing and for operatively connecting said panic bar to said latch actuator such that inward and outward movement of said panic bar relative to said housing causes said actuator to move between said first and second positions, each of said mounting assemblies including a lever link having first and second ends, a link mount fixed to said panic bar, and a link bracket fixed to said housing, said first link end pivotally attached to said link mount, said second link end mounted in a linear slot defined in said link bracket for slidable movement in a direction substantially orthogonal to said rectilinear movement, with an arcuate slot defined in said link bracket within which is slidably received a pin located on said link at a point between said link ends, said arcuate and linear slots being adapted to cause said pin to follow an arcuate path and said second link end to follow a linear path to effect said rectilinear movement, a rotatable dogging axle movable from an undogged position to a dogged position, a pin extending radially from opposite sides of said rotatable dogging axle to effect said dogging, a clip having a pair of stops, said clip being pivotally mounted to a bracket carried by said push bar, with a spring carried by said bracket biasing said clip so that said stops engage with and interfere with the movement of said pin when the door is latched, said clip mounted on said bracket for movement from a first position in which said clip engages said pin and prevents rotation of said dogging axle to said dogged position, to a second position in which said clip is disengaged from said pin and does not prevent rotation of said dogging element to said dogged position, a dogging catch mounted on said housing for engagement by said dogging pin to dog said push bar, said dogging catch engaging said clip and moving said clip from said first position to said second position upon movement of said push bar to unlatch the door latch.

24. The mechanism of claim 23 wherein said dogging axle is mounted for both clockwise and counterclockwise rotation so that said dogging axle may be rotated into said dogged position by rotation in either direction.

25. A panic exit device comprising:

a housing;

a latch having a projected and retracted position;

an actuator having a first position and a second position;

means providing an operative connection between the actuator and said latch to move said latch to a retracted position in response to movement of the actuator from its first position to its second position;

a push plate supported for inward and outward movement relative to said housing and having an inward position and outward position; and means for translating the inward and outward movement of said push plate to said actuator so that when the push plate is in its outward position said actuator is in its first position, and when said push plate is in its inward position said actuator is in its second position, while maintaining said push plate substantially parallel to said housing at all times and without any significant sideways movement of said push plate relative to said housing, said means for translating including a link lever having a first end pivotably attached to one of said housing and said push plate, and a second end pivotally attached to the other of said housing and said push plate via a first pivot member slidably movable in a linear slot formed in a link lever bracket, said linear slot extending generally perpendicular to the direction of movement of said push plate, and a second pivot member slidably movable in an arcuate slot formed in said link lever bracket, said arcuate slot being located between said linear slot and said push bar.

26. A panic exit device comprising:

a housing;

a latch having a projected and a retracted position;

an actuator having a first position and a second position;

means providing an operative connection between the actuator and said latch to move said latch to a retracted position in response to movement of the actuator from its first position to its second position;

a push plate supported for outward and inward movement relative to said housing and having an inward position and outward position;

a link lever pivotally coupled to said push plate; and a link lever bracket mounted on said housing and having a linear slot and an arcuate slot to which the said link lever operatively couples to thereby provide an orthogonal translation of the inward and outward motion of the push plate to the actuator while maintaining the horizontal positioning of the push plate.

27. A fail-safe dogging device for a panic exit device having a push bar mounted for movement in a housing, comprising:

a dogging axle mounted to said push bar and rotatably between a dogged and undogged position;

a dogging member extending radially from the axis of said axle;

a dogging safety clip pivotally mounted relative to said dogging member, said safety clip having a first position wherein said clip engages with said dogging member to prevent said axle from rotating to a dogged position, and a second position wherein said clip is clear of said dogging member and does not prevent said axle from moving to its dogged position, and means for moving said clip from said first position to said second position in response to movement of said push bar into said housing.

28. The mechanism of claim 27 wherein said dogging axle is mounted for both clockwise and counterclockwise rotation so that said dogging axle may be rotated into said dogged position by rotation in either direction.

29. A fail-safe dogging device for a panic exit device having a push bar mounted for movement in a housing, comprising:

a dogging axle engaged to the push bar and movable between a dogged and undogged position;

a dogging member extending radially from the axis of said axle;

a catch mounted to the housing, which catch is engaged by said dogging member when the push bar is in its inward position and said axle is moved to a dogged position; and a dogging safety clip having a biased position and a depressed position, which when in said biased position interferes with said dogging member to prevent said axle from moving to a dogged position and which is moved to said depressed position by an interaction with said catch when the push bar is moved to its inward position in which depressed position said clip does not interfere with movement of said dogging member to allow said axle to move to a dogged position.

30. The mechanism of claim 29 wherein said dogging axle is mounted for both clockwise and counterclockwise rotation so that said dogging axle may be rotated into said dogged position by rotation in either direction.

* * * * *

UNITED STATES PATENT AND TRADEMARK OFFICE

CERTIFICATE OF CORRECTION

PATENT NO. : 5,169,185
DATED : December 8, 1992
INVENTOR(S) : Loren E. Slaybaugh et al.

It is certified that error appears in the above-indentified patent and that said Letters Patent is hereby corrected as shown below:

On title page, Item [56]:
IN THE REFERENCES CITED column 1 of the title pages under "U.S. PATENT DOCUMENTS," after "3,583,740 6/1971", please delete "Armstron" and substitute therefor --Armstrong--.

IN THE CLAIMS

Col. 8, line 50
In claim 9, line 2, after "member" delete "." and substitute therefor --,--. (second occurrence)

Col. 9, line 50
In claim 13, line 6, delete "aid" and substitute therefor --said--.

Col. 10, line 16
In claim 16, line 11, delete "form" and substitute therefor --from--.

Signed and Sealed this
Twenty-seventh Day of September, 1994

Attest:

Bruce Lehman

BRUCE LEHMAN

Attesting Officer

Commissioner of Patents and Trademarks